US010902810B2

(12) United States Patent
Han et al.

(10) Patent No.: US 10,902,810 B2
(45) Date of Patent: Jan. 26, 2021

(54) ARRAY SUBSTRATE GATE DRIVING UNIT AND APPARATUS THEREOF, DRIVING METHOD AND DISPLAY APPARATUS

(71) Applicant: BOE Technology Group Co., Ltd., Beijing (CN)

(72) Inventors: Mingfu Han, Beijing (CN); Guangliang Shang, Beijing (CN); Xing Yao, Beijing (CN); Seung Woo Han, Beijing (CN); Jiha Kim, Beijing (CN); Haoliang Zheng, Beijing (CN); Lijun Yuan, Beijing (CN); Zhichong Wang, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 312 days.

(21) Appl. No.: 15/751,066

(22) PCT Filed: Jul. 28, 2017

(86) PCT No.: PCT/CN2017/094820
§ 371 (c)(1),
(2) Date: Feb. 7, 2018

(87) PCT Pub. No.: WO2018/126656
PCT Pub. Date: Jul. 12, 2018

(65) Prior Publication Data

US 2020/0090611 A1 Mar. 19, 2020

(30) Foreign Application Priority Data

Jan. 3, 2017 (CN) ..... 2017 1 0001592

(51) Int. Cl.
*G09G 3/36* (2006.01)

(52) U.S. Cl.
CPC ..... *G09G 3/3677* (2013.01); *G09G 3/3696* (2013.01)

(58) Field of Classification Search
CPC ..... G09G 3/3677; G09G 3/3696
See application file for complete search history.

(56) References Cited

U.S. PATENT DOCUMENTS

2014/0169518 A1 6/2014 Kong et al.
2015/0043703 A1* 2/2015 Tan ..... G11C 19/28 377/68

(Continued)

FOREIGN PATENT DOCUMENTS

CN 103065578 A 4/2013
CN 103474038 A 12/2013

(Continued)

OTHER PUBLICATIONS

Oct. 20, 2017—(WO) International Search Report and Written Opinion Appn PCT/CN20171094820 with English Tran.

*Primary Examiner* — Mark W Regn
(74) *Attorney, Agent, or Firm* — Banner & Witcoff, Ltd.

(57) ABSTRACT

The present disclosure relates to an array substrate gate driving unit and an apparatus thereof, a driving method and a display apparatus. The array substrate gate driving unit includes: an input circuit, connected with an input signal terminal and a pull-up node PU; a pull-down circuit, connected with a first voltage signal terminal and the pull-up node PU; a pull-down control circuit, connected with the pull-down circuit via a pull-down node PD; an output circuit, connected with a clock signal terminal CLK, a second voltage signal terminal and a control circuit; a reset circuit, connected with a reset signal terminal Reset, the first (Continued)

voltage signal terminal and the pull-up node PU; and the control circuit, connected with the pull-up node PU and the output circuit.

11 Claims, 9 Drawing Sheets

(56) References Cited

U.S. PATENT DOCUMENTS

| | | | |
|---|---|---|---|
| 2015/0325190 | A1 | 11/2015 | Cao |
| 2016/0266699 | A1 | 9/2016 | Zhao et al. |
| 2016/0307531 | A1 | 10/2016 | Xiao |
| 2017/0270851 | A1 | 9/2017 | Shang et al. |
| 2017/0330526 | A1 | 11/2017 | Fan et al. |

FOREIGN PATENT DOCUMENTS

| | | | |
|---|---|---|---|
| CN | 103700355 | A | 4/2014 |
| CN | 104021769 | A | 9/2014 |
| CN | 105096865 | A | 11/2015 |
| CN | 105185349 | A | 12/2015 |

* cited by examiner

ARRAY SUBSTRATE GATE DRIVING UNIT AND APPARATUS THEREOF, DRIVING METHOD AND DISPLAY APPARATUS

The application is a U.S. National Phase Entry of International Application No. PCT/CN2017/094820 filed on Jul. 28, 2017, designating the United States of America and claiming priority to Chinese Patent Application No. 201710001592.2 filed on Jan. 3, 2017. The present application claims priority to and the benefit of the above-identified applications and the above-identified applications are incorporated by reference herein in their entirety.

TECHNICAL FIELD

The present disclosure relates to a gate driving technology, in particular to an array substrate gate driving (GOA) apparatus and a method thereof and a display apparatus.

BACKGROUND

In the conventional technology, driving circuits in a liquid crystal display is mainly implemented by connecting an integrated circuit outside the liquid crystal panel. For a long time, it has always been a target in the display field to integrate a peripheral driving circuit and a pixel driving array of the display on the same substrate. Gate and column driving circuits which are based on TFTs are an important research trend of large-sized microelectronics, and they can be applied to active display panels such as TFT-LCD, TFT-OLED and the like and can be applied to new displays such as transparent display, flexible display, electronic label and the like.

TFT gate driving circuits include gate-driver on array (GOA) technology, which mainly involves a GOA circuit using amorphous silicon (A-Si) TFT or IGZO-TFT. GOA technology involves fabricating gate driving circuits on an array substrate directly to replace a driving chip fabricated on an external silicon chip. As the GOA circuit can be directly fabricated on the periphery of a panel, simplifying manufacturing process, reducing product costs and improving the integration of the liquid crystal panel, so that the panel tends to become thinner.

However, transistor charging time is significantly reduced for large-sized, high-resolution LCD products. For 8K $\alpha$-Si products, the turning-on time of one row of pixels is only 3.7 μsand the actual effective pixel charging time is less. Therefore, even if the charging time increases by 0.1 μsmagnitude, the charging rate can be improved remarkably to achieve a higher display quality.

In addition, in an existing GOA circuit, the leakage current increases during a pull-up (PU) holding phase due to loads of an input circuit, a reset circuit, and a pull-down circuit.

In view of the above, under the current circumstances, there is an urgent need to increase the voltage of the pull-up node and reduce the leakage current during the PU holding phase so as to enhance the driving capability of the GOA circuit, reduce the falling time of pixels, and further increase the charging time.

SUMMARY

The present disclosure provides an array substrate gate driving unit and an apparatus thereof, a driving method and a display apparatus.

An embodiment of the present disclosure provides a GOA unit, comprising: an input circuit, connected with an input signal terminal and a pull-up node PU; a pull-down circuit, connected with a first voltage signal terminal and the pull-up node PU; a pull-down control circuit, connected with the pull-down circuit via a pull-down node PD; an output circuit, connected with a clock signal terminal, a second voltage signal terminal and a control circuit; a reset circuit, connected with a reset signal terminal, the first voltage signal terminal and the pull-up node PU; and the control circuit, connected with the pull-up node PU and the output circuit. The input circuit controls a potential of the pull-up node PU in response to a received input signal; the output circuit generates an output signal in response to a clock signal input to the output circuit and the potential of the pull-up node PU; and the control circuit disconnects the control circuit from the pull-up node PU in response to the output signal generated by the output circuit.

The control circuit can comprise an inverter and a control switching element.

The control switching element can comprise a first transistor, a drain electrode of the first transistor is connected with a gate electrode signal terminal of the output circuit, a gate electrode of the first transistor is connected with the inverter, and a source electrode of the first transistor is connected with the input circuit, the reset circuit and the pull-down circuit via the pull-up node PU.

The inverter can comprise a second transistor and a third transistor, a gate electrode and a drain electrode of the second transistor can be connected with a third voltage signal terminal, and a source electrode of the second transistor can be connected with the gate electrode of the first transistor and a drain electrode of the third transistor.

The inverter can comprise a second transistor, a third transistor and a fourth transistor, a drain electrode of the second transistor and a gate electrode and a drain electrode of the fourth transistor can be connected with a direct current high voltage signal, a gate electrode of the second transistor can be connected with a source electrode of the fourth transistor, and a source electrode of the second transistor can be connected with the gate electrode of the first transistor and a drain electrode of the third transistor.

A source electrode of the third transistor can be connected with a direct current low voltage signal, the drain electrode of the third transistor can be connected with the source electrode of the second transistor, and a gate electrode of the third transistor can be connected with an output terminal of the output circuit.

Resistance of the second transistor can be greater than resistance of the third transistor.

The clock signal, the first voltage signal, the second voltage signal and the third voltage signal can be input to the GOA unit.

An embodiment of the present disclosure further provides a driving method for the GOA unit according to the present disclosure, the driving method comprises the following steps: controlling the potential of the pull-up node PU by the input circuit in response to the received input signal; generating the output signal by the output circuit in response to the clock signal input to the output circuit and the potential of the pull-up node PU; and disconnecting the control circuit from the pull-up node PU by the control circuit in response to the output signal generated by the output circuit.

In the driving method for the GOA unit, the control circuit can disconnect a source electrode of a first transistor included in the control circuit from the pull-up node PU in response to the output signal generated by the output circuit.

The driving method for the GOA unit can further comprise: the control circuit switches on the connection of the source electrode of the first transistor to the pull-up node PU in response to the clock signal input to the output circuit, after disconnecting the source electrode of the first transistor from the pull-up node PU.

An embodiment of the present disclosure further provides a GOA apparatus, comprising a plurality of cascaded GOA units according to the present disclosure.

In the cascaded GOA units, a signal input terminal of each GOA unit except for a first GOA unit and a last GOA unit is connected to an output terminal of a preceding GOA unit that is adjacent to the each GOA. A reset signal terminal of each GOA unit except for the first GOA unit and the last GOA unit is connected to an output terminal of a following GOA unit that is adjacent to the each GOA.

An embodiment of the present disclosure further provides a display apparatus, comprising the GOA apparatus according to the present disclosure.

According to the present disclosure, by providing the array substrate gate driving unit and the apparatus thereof, the driving method and the display apparatus, it can be possible of increasing the clock signal coupling effect, reducing the leakage current during the PU holding phase and increasing the turning-on voltage of the output transistor, thereby possible to enhance the driving capability of the transistor significantly.

BRIEF DESCRIPTION OF THE DRAWINGS

In order to clearly illustrate the technical solution of the embodiments of the disclosure, the drawings of the embodiments will be briefly described in the following; it is obvious that the described drawings are only related to some embodiments of the disclosure and thus are not limitative of the disclosure.

DETAILED DESCRIPTION

Figure 1:
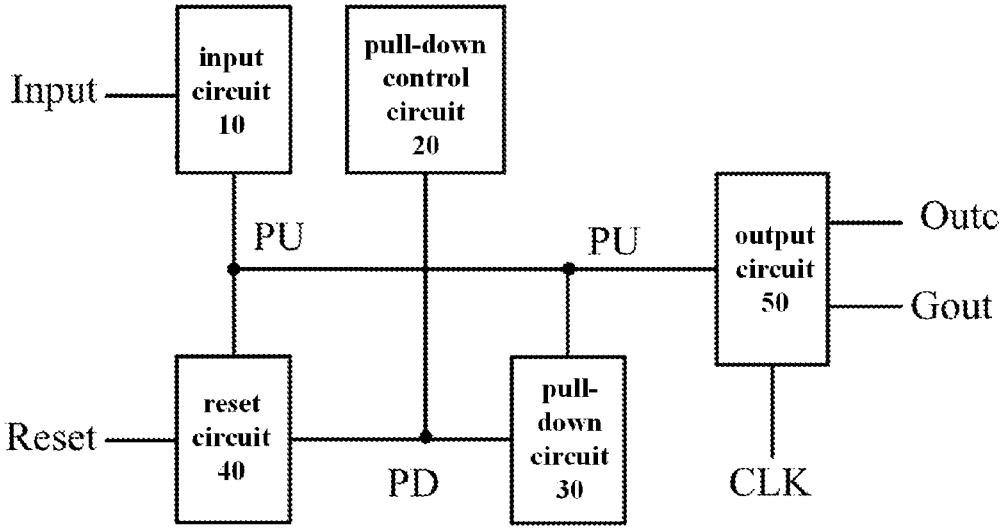
(Prior Art) FIG. 1
FIG. 1 is a schematic diagram of the functional structure of each GOA unit in a gate driving circuit known to the inventors.

Embodiments of the present disclosure are described with reference to the drawings to describe the present disclosure in detail, so that those skilled having ordinary knowledge in the art can easily practice the present disclosure. However, the present disclosure can be realized in various forms and is not limited to the following embodiments. In the drawings, to clearly describe the present disclosure, the descriptions of components that are not directly related to the present disclosure will be omitted, and the same or similar elements are designated by the same reference numerals throughout the drawings.

In addition, throughout the specification, it should be understood that the recitation that the first component is "connected" to the second component can include the case where the first component is electrically connected to the second component with some other component interposed therebetween, and the case where the first component is "directly connected" to the second component. In addition, it should be understood that the recitation that the first component "includes" the second component means that other components can be further included, without excluding the possibility of adding other components unless the contrary is specifically indicated in the context.

It should be noted that a source electrode and a drain electrode of a TFT adopted in the embodiments of the present disclosure are symmetrical, and names of the source electrodes and the drain electrodes of all the TFTs can be exchanged with each other. In addition, the TFTs can be divided into N-type transistors or P-type transistors according to characteristics of the TFTs. In the embodiments of the present disclosure, when an N-type TFT is adopted, its first electrode can be a source electrode, and its second electrode can be a drain electrode. The TFTs adopted in the embodiments of the present disclosure can be N-type transistors or P-type transistors. In the following embodiments, descriptions are given by taking the TFTs being the N-type transistors as an example, that is, when a signal of a gate electrode is at a high level, the TFT is turned on. However, it can be understood that, when a P-type transistor is adopted, the timing of the driving signal needs to be adjusted correspondingly.

In the following, preferred embodiments of the present disclosure will be described in detail with reference to the drawings.

FIG. 1 is a schematic diagram of the functional structure of each GOA unit in a gate driving circuit known to the inventors.

FIG. 1 is a schematic diagram showing the functional structure of each GOA unit in the GOA circuit known to the inventors. The GOA circuit possesses a plurality of cascaded GOA units and each stage of the GOA units can drive two adjacent rows of pixels. Specifically, each stage of the GOA units drives two adjacent rows of pixels through two gate driving lines. When the GOA unit outputs a high-level signal, the corresponding two adjacent rows of pixels are driven by the corresponding gate driving lines to be turned on, so that the adjacent two rows of pixels are capable of receiving data signals; when the GOA unit outputs a low-level signal, the corresponding two adjacent rows of pixels are turned off to stop receiving the data signals. In this way, in one frame, the cascaded GOA units in the gate driving circuit output high-level signals sequentially and drive by the unit of two adjacent rows of pixels sequentially.

As shown in FIG. 1, each GOA unit includes an input circuit 10, a pull-down control circuit 20, a pull-down circuit 30, a reset circuit 40, and an output circuit 50. The input circuit 10 is connected with an input signal terminal and a pull-up node PU. The pull-down control circuit 20 is connected with the pull-down circuit 30 via a pull-down node PD. The pull-down circuit 30 is connected with the pull-up node PU and the pull-down node PD. The reset circuit 40 is connected with a reset signal terminal, the pull-up node PU and the pull-down node PD. The output circuit 50 is connected with a clock signal terminal, the pull-up node PU and an output terminal. The output circuit 50 is turned on when the CLK is at a high level, thereby outputting an output signal as an input signal of the next stage.

Figure 2:
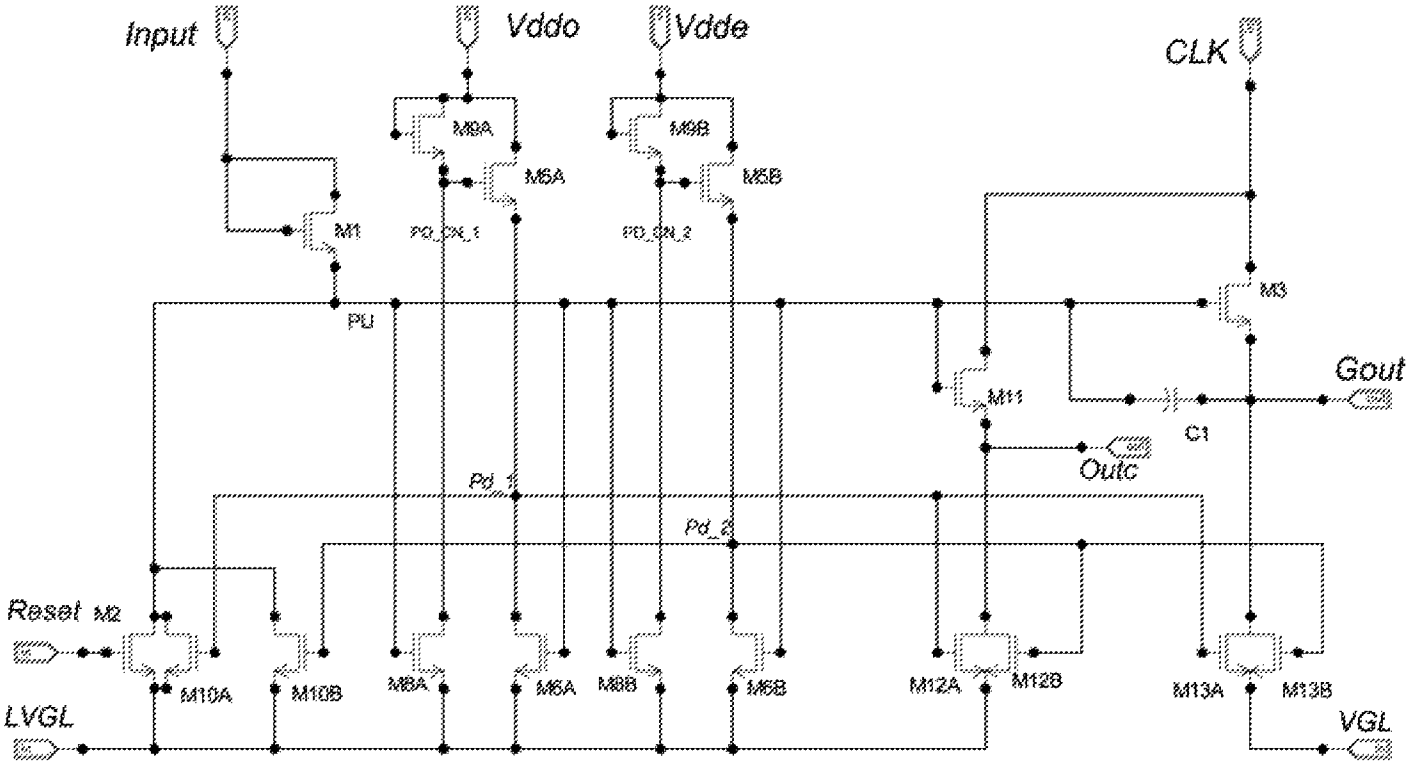
(Prior Art) FIG. 2
FIG. 2 is a schematic diagram of the specific component structure of a GOA unit known to the inventors.

FIG. 2 is a schematic diagram of the specific component structure of a GOA unit known to the inventors. Specifically, as shown in FIG. 1 and FIG. 2, each stage of the GOA units includes the input circuit 10, the pull-down control circuit 20, the pull-down circuit 30, the reset circuit 40 and the output circuit 50. The input circuit 10 transfers a high-level voltage signal to the pull-up node PU in response to the output signal of the preceding stage GOA unit. When the pull-up node PU is at a high level, the pull-down control circuit 20 turns on the pull-down circuit to lower the voltage of the pull-down node PD. The reset circuit 40 is connected with a reset signal terminal Reset, a first DC low-level voltage signal terminal LVGL (first voltage signal terminal) and the pull-up node PU. The reset circuit 40 provides the first DC low-level voltage signal LVGL to the pull-up node PU in response to a reset signal Reset outputted by the reset signal terminal. The output circuit 50 is turned on when the CLK is at a high level, and the voltage of the pull-up node PU is further increased, thereby completing the charging process of the transistor. The pull-down circuit 30 provides the first DC low-level voltage signal LVGL to the pull-up node PU and the output terminal Output in response to a voltage signal of the pull-down node PD.

When a rising edge of the clock signal arrives, the voltage of the pull-up node PU is increased as follows:

$$\Delta V=(Vgh-Vgl)*(CgsM3+CgdM3+CgsM11+CgdM11+C1)/(CgsM3+CgdM3+CgsM11+CgdM11+C1+2*CgsM8+2*CgdM8+CgsM1+2CgdM10+CgdM2+2*CgsM6+2*CgdM6) \quad \text{Equation (1)}$$

Figure 4:
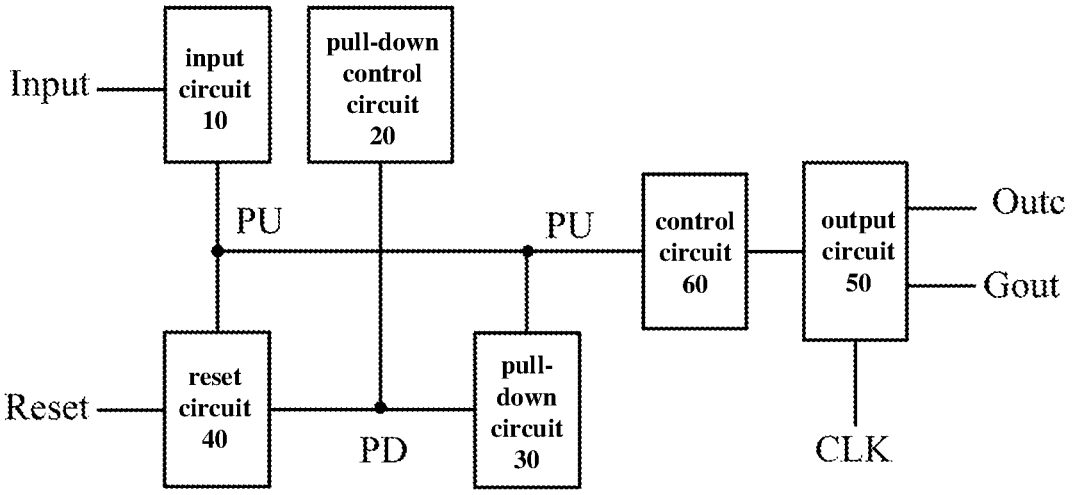
FIG. 4 is a schematic diagram of the functional structure of each GOA unit in a gate driving circuit according to an embodiment of the present disclosure.

FIG. 4 is a schematic diagram of the functional structure of each GOA unit in a gate driving circuit according to an embodiment of the present disclosure.

A GOA apparatus according to an embodiment of the present disclosure can typically include a plurality of cascaded GOA units, and each GOA unit includes an input circuit 10, a pull-down control circuit 20, a pull-down circuit 30, a reset circuit 40, an output circuit 50 and a control circuit 60. The GOA apparatus according to an embodiment of the present disclosure is applicable to various displays such as a liquid crystal display or the like.

As shown in FIG. 4, the control circuit 60 is connected between the pull-up node PU and the output circuit 50. One terminal of the control circuit 60 is connected with the input circuit 10, the reset circuit 40 and the pull-down circuit 30 via the pull-up node PU, and the other terminal of the control circuit 60 is connected with the output circuit 50. The output circuit 50 can generate an output signal in response to the level of the clock signal CLK input to the output circuit, specifically in response to the high level of CLK. The control circuit 60 can cut off the connection with the pull-up node PU in response to the output signal generated by the output circuit 50, that is, cut off the connection with the input circuit, the reset circuit and the pull-down circuit to form a new pull-up node PU2.

Figure 5:
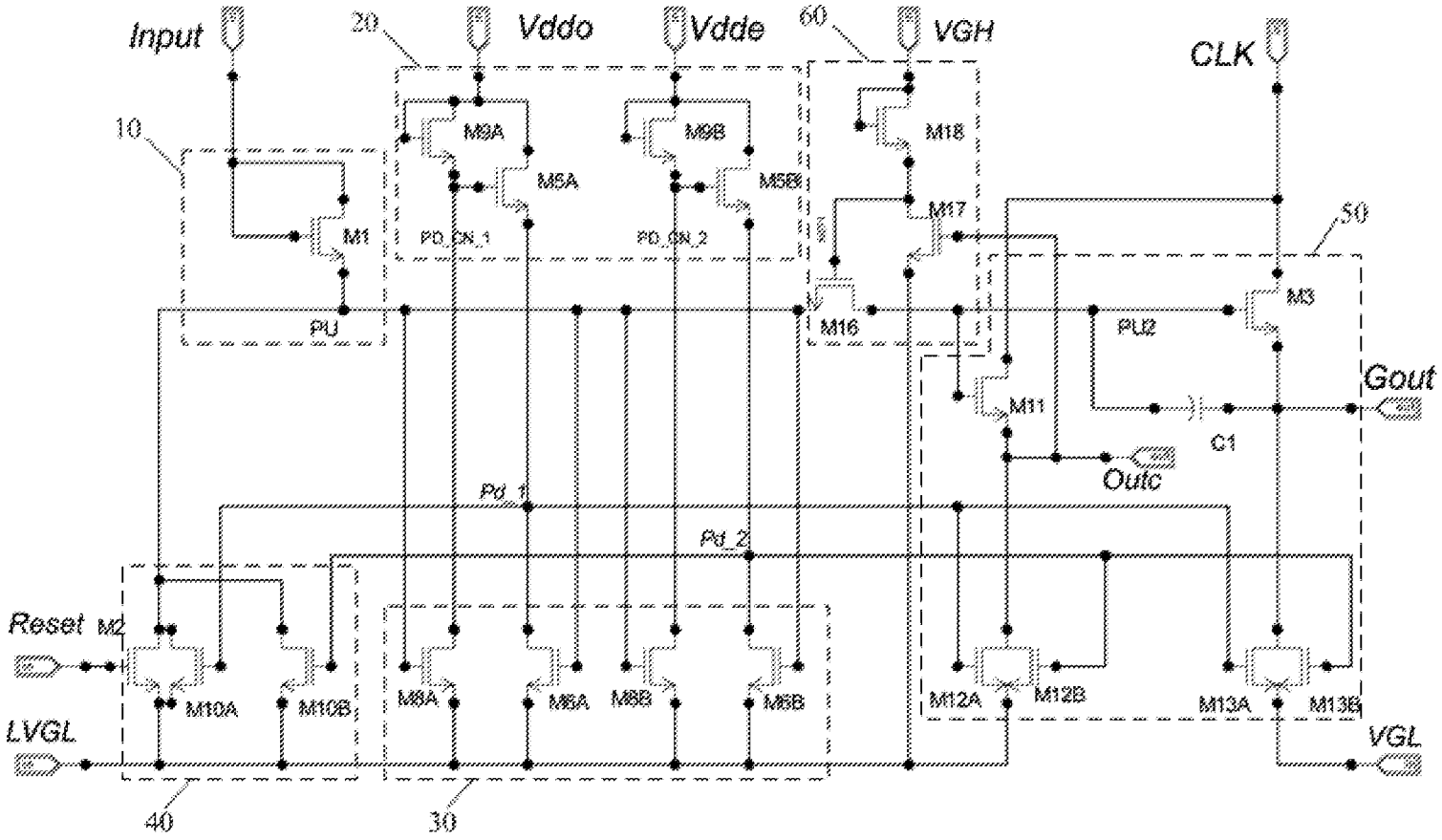
FIG. 5 is a schematic diagram of the specific component structure of a GOA unit according to a first embodiment of the present disclosure.
Figure 6:
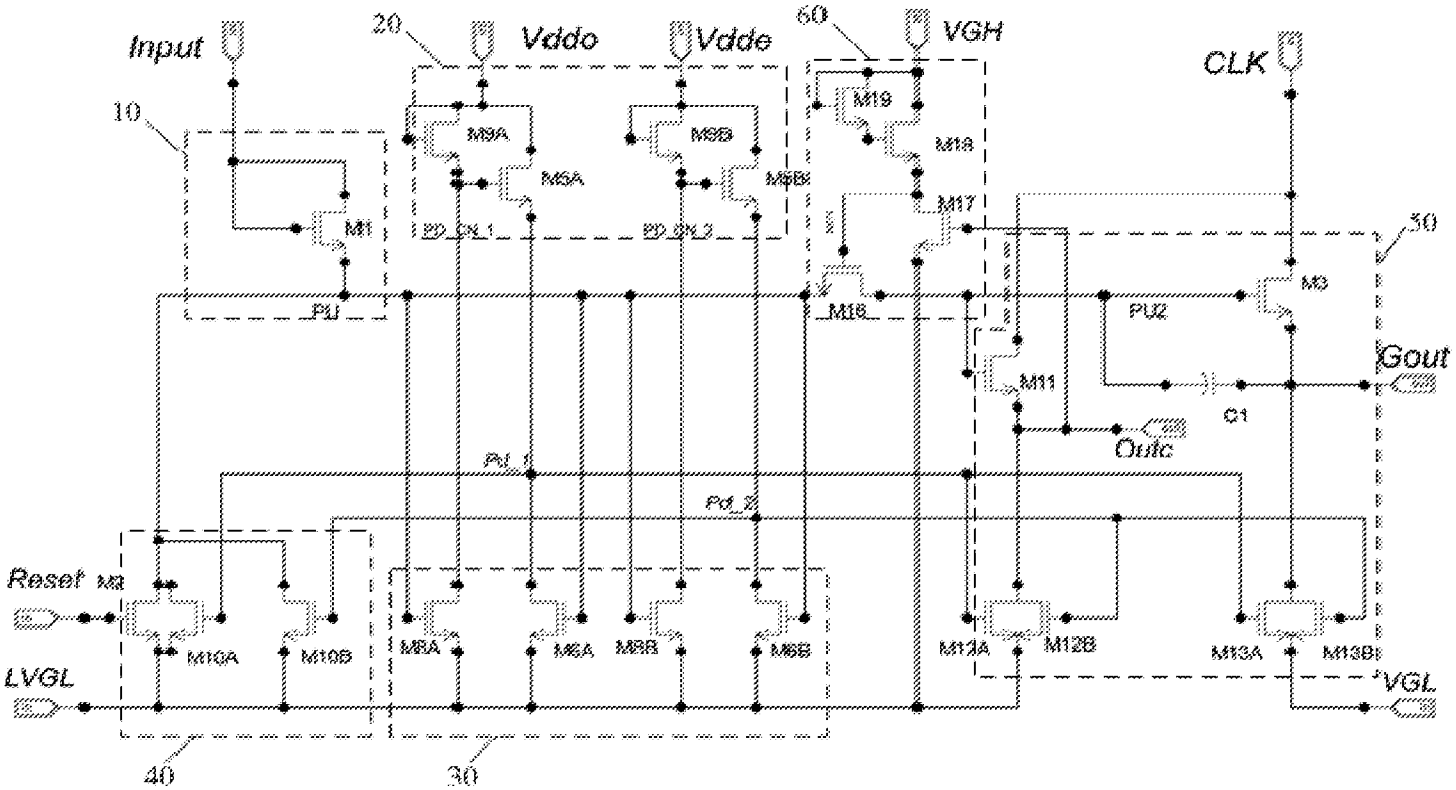
FIG. 6 is a schematic diagram of the specific component structure of a GOA unit according to a second embodiment of the present disclosure.
Figure 7:
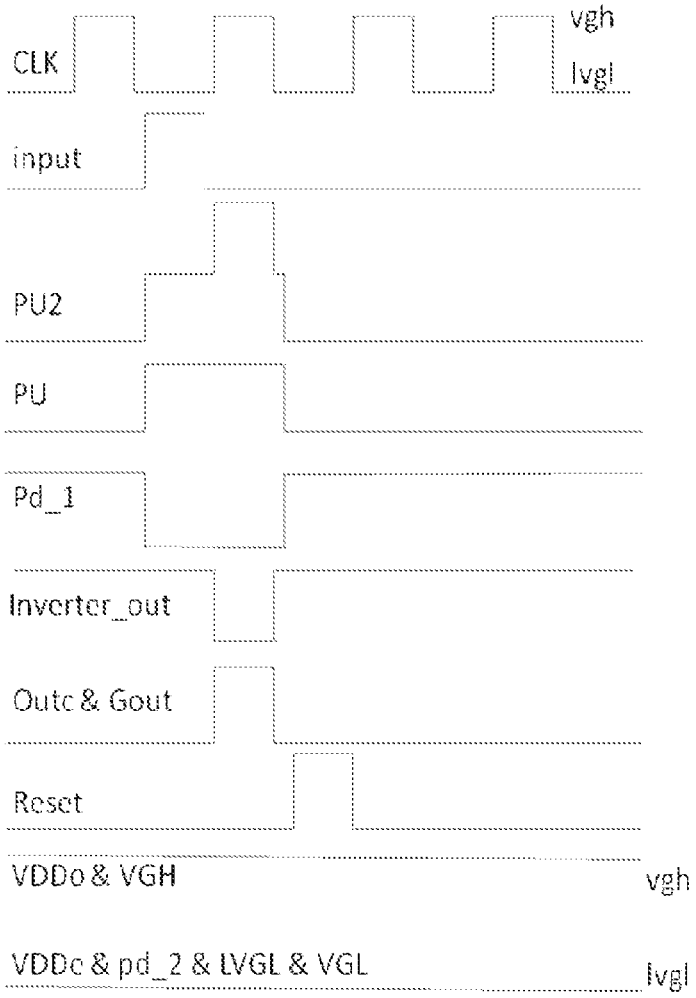
FIG. 7 is a timing diagram of input and output signals of a GOA unit according to an embodiment of the present disclosure.

FIG. 5 is a schematic diagram of the specific component structure of a GOA unit according to the first embodiment of the present disclosure. FIG. 6 is a schematic diagram of the specific component structure of a GOA unit according to the second embodiment of the present disclosure. FIG. 7 is a timing diagram of input and output signals of a GOA unit according to an embodiment of the present disclosure.

Figure 3:
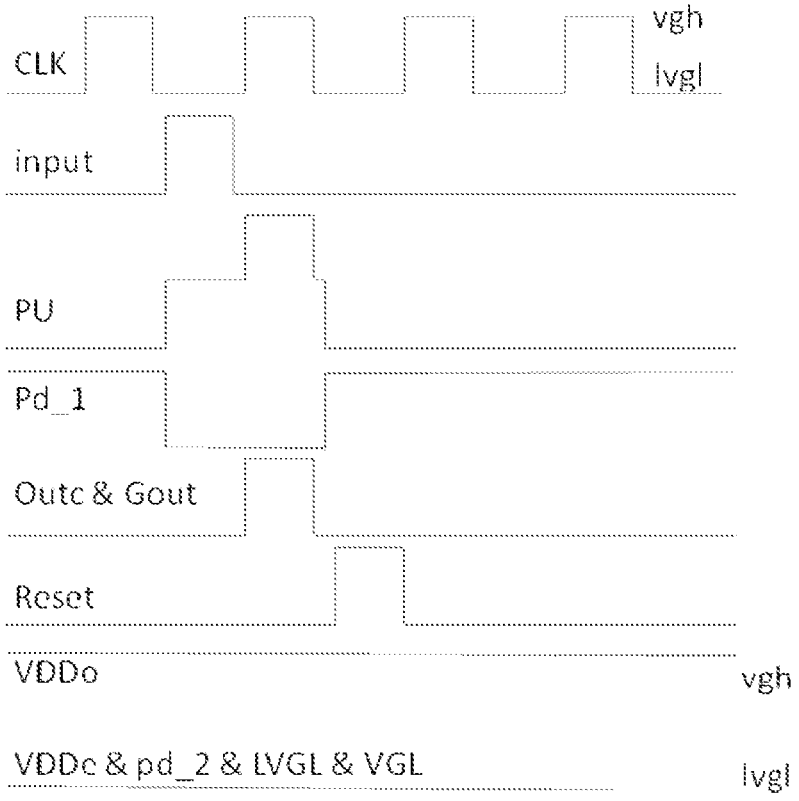
(Prior Art) FIG. 3
FIG. 3 is a timing diagram of input and output signals of a GOA unit known to the inventors.

A timing diagram of input and output signals of a GOA unit known to the inventors is shown in FIG. 3. A timing diagram of input and output signals of a GOA unit according to the present disclosure is shown in FIG. 7, where CLK is the clock signal of the GOA unit; the sign "Input" represents the input signal of the input circuit, that is, the output signal of the preceding stage GOA unit; PU represents the voltage of the pull-up node; Pd_1 and Pd_2 represent voltages of the first pull-down node and the second pull-down node; Outc and Gout are output signals of the output circuit; Reset represents a reset input signal of the GOA circuit, that is, the output signal of the next stage GOA unit; Vddo and Vdde are the high-level voltage signal and the low-level voltage signal which are alternated; VGH is a DC high-level voltage signal (third voltage signal terminal), and the voltage of VGH can be, for example, but not limited to 20-30V; LVGL and VGL are a first DC low-level voltage signal and a second DC low-level voltage signal, respectively, the voltage of the first DC low-level voltage signal LVGL can be, for example, but not limited to −10V, the voltage of the second DC low-level voltage signal VGL can be, for example, but not limited to −8V.

In the following detailed description is conducted with reference to FIGS. 5-7.

In FIG. 5, the input circuit 10 is connected with a signal input terminal Input and the pull-up node PU and is configured to provide a high-level voltage signal Input to the pull-up node PU in response to the input signal Input of the signal input terminal.

The input circuit 10 includes a transistor M1. A gate electrode and a drain electrode of M1 is connected with the signal input terminal Input, and a source electrode of M1 is connected with the pull-up node PU. When the input signal Input jumps to a high level, the voltage of the pull-up node PU is at a high level and the pull-down circuit is turned on, thereby lowering the voltage of the pull-down node PD. The specific implementation structure, control method, and the like of the input circuit 10 do not limit the embodiments of the present disclosure.

The reset circuit 40 is connected with the reset signal terminal Reset, the first DC low-level voltage signal terminal LVGL and the pull-up node PU. The reset circuit 40 is configured to provide the first DC low-level voltage signal LVGL to the pull-up node PU in response to the reset signal Reset outputted by the reset signal terminal. The reset circuit 40 includes transistors M2, M10A and M10B. A gate electrode of the transistor M2 is connected with the terminal Reset, a drain electrode of the transistor M2 is connected with drain electrodes of transistors M10A and M10B, and a source electrode of the transistor M2 is connected with the first DC low-level voltage signal terminal LVGL.

The pull-down control circuit 20 is connected with the high-level voltage signal terminal Vdde or Vddo, the pull-down circuit 30 and the pull-down nodes Pd_1 and Pd_2. The pull-down control circuit 20 is configured to provide the first DC low-level voltage signal LVGL to the pull-down nodes Pd_1 and Pd_2 in response to a voltage signal of the pull-up node PU; and provide the high-level voltage signal Vdde or Vddo to the pull-down nodes Pd_1 and Pd_2 in response to the high-level voltage signal Vdde or Vddo.

Specifically, in the pull-down control circuit 20, when the pull-up node PU is at a high level, the transistor M6A and the transistor M6B are turned on and the pull-down node Pd_1 or Pd_2 is pulled down to a low level, that is, pulled down to be equal to or close to a voltage of the low level. When the pull-up node PU is at a low level, the transistor M6A and the transistor M6B are turned off while the high-level voltage Vddo or Vdde turns on the transistor M5A and the transistor MSB, so that the pull-down node Pd_1 or Pd_2 is at a high level.

The pull-down control circuit 20 described above is merely an example, and it can further possess other structures. The high-level voltages Vddo and Vdde are inverted in phase in time sequence, so that the two pull-down circuits work alternately to achieve the effect of prolonging the service life.

The pull-down circuit 30 is connected with the pull-down control circuit 20, the pull-up node PU, the first DC low-level voltage signal terminal LVGL, the pull-down node PD and the output circuit 50. The pull-down circuit 30 is configured to provide the DC low-level voltage signal LVGL to the pull-up node PU and the output circuit 50 in response to the voltage signal of the pull-down node PD.

The pull-down circuit 30 includes a transistor M8A, the transistor M6A, a transistor M8B and the transistor M6B, the gate electrodes of the transistors M8A, M6A, M8B and M6B are connected with the pull-up node PU, and source electrodes of the transistors M8A, M6A, M8B and M6B are connected with the first DC low-level voltage signal terminal LVGL. Drain electrodes of the transistors M8A and M8B are connected with the pull-down control circuit 20, a drain electrode of the transistor M6A is connected with the first pull-down node Pd_1, and a drain electrode of the transistor M6B is connected with the second pull-down node Pd_2.

The output circuit 50 is connected with a clock signal terminal CLK, the second DC low-level voltage signal terminal VGL (second voltage signal terminal), the control circuit 60 and the present stage output terminals Outc and Gout. The output circuit 50 is configured to provide the present stage output Outc and Gout in respond to the clock signal terminal CLK inputted by the clock signal terminal.

The circuit 50 includes output transistors M3 and M11, and noise reduction transistors M12A, M12B, M13A and M13B. Drain electrodes of the output transistors M3 and M11 are connected with the clock signal terminal CLK, and gate electrodes of M3 and M11 are connected with the control circuit 60. A source electrode of the output transistor M3 is connected with drain electrodes of the noise reduction transistors M13A and M13B, and a source electrode of the output transistor M11 is connected with drain electrodes of the noise reduction transistors M12A and M12B. Source electrodes of the noise reduction transistors M12A and M12B are connected with the first DC low-level voltage signal terminal LVGL, a gate electrode of the noise reduction transistor M12A is connected with the first pull-down node Pd_1, and a gate electrode of the noise reduction transistor M12B is connected with the second pull-down node Pd_2. Source electrodes of the noise reduction transistors M13A and M13B are connected with the second DC low-level voltage signal terminal VGL, a gate electrode of the noise reduction transistor M13A is connected with the first pull-down node Pd_1, and a gate electrode of the noise reduction transistor M13B is connected with the second pull-down node Pd_2.

The output circuit 50 according to an embodiment of the present disclosure performs the operation of output according to a trigger of a rising edge of the clock signal when the voltage of the pull-up node PU is at a high level, and stops the operation of output according to a trigger of a falling edge of the clock signal.

Figure 8:
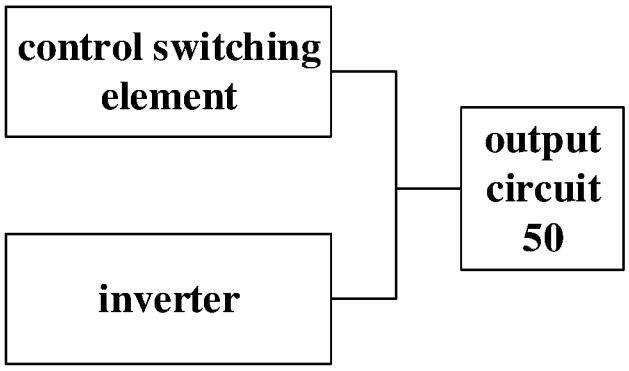
FIG. 8 is a schematic diagram of a control circuit in a GOA unit according to an embodiment of the present disclosure.

FIG. 8 is a schematic diagram of a control circuit in a GOA unit according to an embodiment of the present disclosure.

As shown in FIG. 8, the control circuit includes an inverter and a control switching element, one terminal of the control circuit is connected with the pull-up node PU, and the other terminal of the control circuit is connected with the output circuit 50.

In FIG. 5 and FIG. 6, the control switching element is a first transistor M16, a drain electrode of M16 is connected with a gate signal terminal (that is, a pull-up node PU2 to be formed later) of the output circuit, a gate electrode of M16 is connected with one terminal of the inverter, and a source electrode of M16 is connected with the input circuit, the reset circuit, and the pull-down circuit via the pull-up node PU.

In FIG. 5, the inverter includes a second transistor M18 and a third transistor M17 that are connected in series. Resistance of the second transistor M18 is greater than resistance of the third transistor M17. The gate electrode and the drain electrode of the second transistor M18 are connected with the VGH, that is, a DC high voltage signal, so that the second transistor M18 is always in an on-state. The drain electrode of the third transistor M17 is connected with the source electrode of the second transistor M18 and the gate electrode of the first transistor M16. Because the second transistor M18 is turned on, the drain electrode of the third transistor M17, the source electrode of the second transistor M18, and the gate electrode of the first transistor M16 are all at high levels, the first transistor M16 is turned on. In addition, in most cases, the third transistor M17 is turned off because the levels of the output signals Outc and Gout are low.

The operation of the GOA unit according to an embodiment of the present disclosure is described in detail below.

When a preceding stage GOA unit outputs a gate driving signal OUTPUT_n−1, that is, the Input terminal of the present stage GOA unit is at a high level, the transistor M1 of the input circuit is turned on, causing the voltage of the pull-up node PU to increase. The boosted voltage of the pull-up node PU turns on the output transistors M3 and M11. Thereafter, when the clock signal CLK of the output circuit 50 jumps from a low level to a high level, because the output transistors M3 and M11 are turned on, the high-level signal of the clock signal CLK is transmitted to the gate electrode of M3 and the gate electrode of M11. The source electrode of M11, i.e., the output terminal Outc, outputs a high-level signal Outc, and the source electrode of M3, i.e., the output terminal Gout, outputs a high-level signal Gout. The high-level signal Outc is connected with a gate electrode of the third transistor M17 in the inverter, so that the third transistor M17 is turned on. When the third transistor M17 is turned on, the drain electrode of M17, the source electrode of M18, and the gate electrode of M16 all decrease in level because resistance of the third transistor M17 is less than resistance of the second transistor M18. The decrease of the gate level of M16 results in the turn-off operation of the first transistor M16. The turn-off of the first transistor M16 causes the control circuit 60 to be disconnected from the pull-up node PU, that is, the connection of the control circuit 60 with the input circuit, the reset circuit and the pull-down circuit is opened, which corresponds to remove the loads of the transistors M1, M2, M6A, M6B, MBA, MBB, M10A, and M10B.

At this moment, the voltage of the newly formed pull-up node PU2 is increased as follows:

$$\Delta V'=(Vgh-Vgl)*(CgsM3+CgdM3+CgsM11+CgdM11+C1)/(CgsM3+CgdM3+CgsM11+CgdM11+C1+CgdM16) \quad \text{Equation (2)}$$

From the comparison of the above equation (1) and equation (2), it can be seen that the value of ΔV' is significantly higher than the value of ΔV. That is to say, this achieves a further increase in the voltage of the pull-up node in comparison with the circuit known to the inventors.

Next, when the clock signal CLK changes from a high level to a low level, the output transistors M3 and M11 are kept and the levels of the output terminals Outc and Gout are pulled down rapidly, so the output is stopped.

The transistor M17 is turned off during the outputs of the output terminal Outc and the output terminal Gout being stopped. Because the DC high-level voltage signal VGH is always applied to the drain electrode and the gate electrode of the second transistor M18, the second transistor M18 remains to be turned on. The levels of the drain electrode of M17, the source electrode of M18 and the gate electrode of M16 are raised. The increase of the gate level of M16 directly causes the first transistor M16 to be turned on. The turning-on state of the first transistor M16 causes the connection of the control circuit 60 with the pull-up node PU to resume.

When the next stage GOA unit outputs OUTPUT_n+2, that is, when the RESET of the present stage GOA unit is at a high level, the transistor M2 is turned on to discharge the pull-up node PU and pull down the voltage of the pull-up node PU, so that voltages of the gate electrodes of the transistors M3 and M11 are pulled down, the transistors M3 and M11 are turned off, the signal CLK can not be transferred to the gate electrodes of M3 and M11, the transistors M3 and M11 remain the turning-off state, the output terminal OUTPUT_n and the output terminal OUTPUT_n+1 of the present stage GOA unit stop output.

During the above process, the transistors M12A, M12B, M13A and M13B are also turned on when the signal CLK is at a high level, that is, when the present stage GOA unit outputs normally, stabilizing the voltage of the pull-up node PU and reducing noise.

The circuit structure of FIG. 6 is substantially the same as that of FIG. 5, except for the inverter section.

The inverter of FIG. 6 includes the second transistor M18, the third transistor M17 and a fourth transistor M19, the drain electrode of the second transistor M18 and a gate electrode and a drain electrode of the fourth transistor M19 are all connected with the DC high voltage signal. The gate electrode of the second transistor M18 is connected with a source electrode of the fourth transistor M19, and the source electrode of the second transistor M18 is connected with the gate electrode of the first transistor M16 and the drain electrode of the third transistor M17.

Compared with the structure of the inverter of FIG. 5, the structure of the inverter of FIG. 6 can compensate for the output attenuation, so that the voltage of the gate electrode of the first transistor M16 is further reduced to achieve a better effect of preventing leakage current.

Figure 9A:
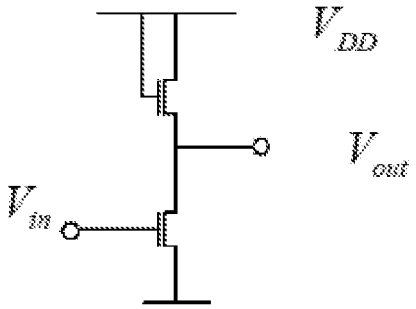
FIG. 9(*a*) and FIG. 9(*b*) are schematic diagrams of the component structure of an inverter according to the first embodiment of the present disclosure.
Figure 9B:
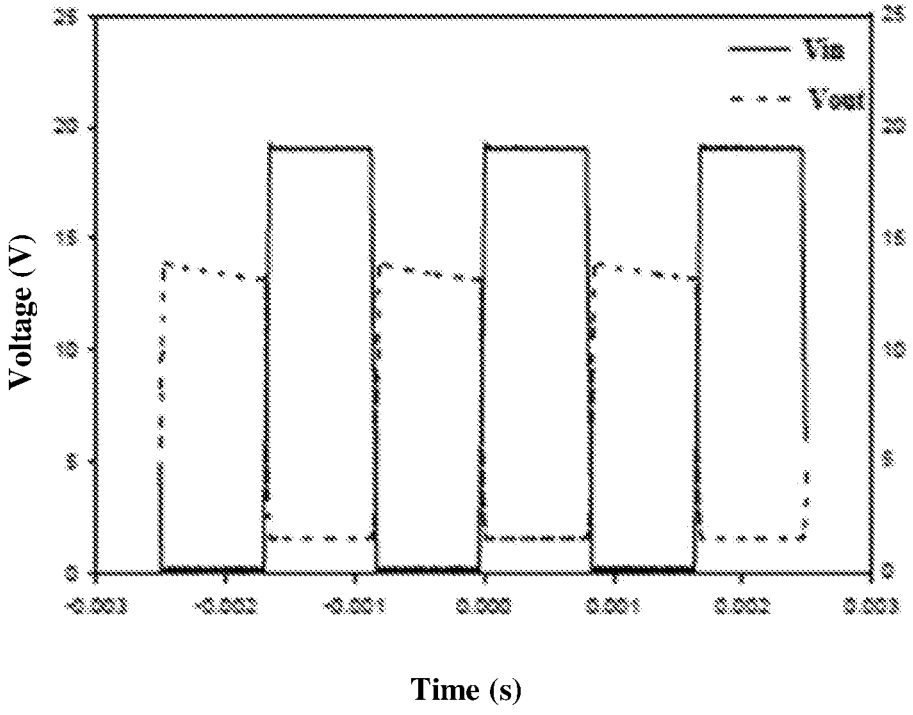
Figure 10A:
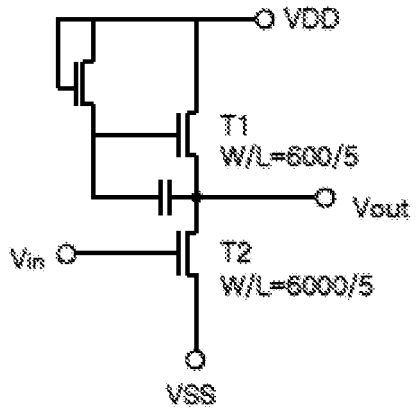
FIG. 10(*a*) and FIG. 10(*b*) are schematic diagrams of the component structure of an inverter according to the second embodiment of the present disclosure.
Figure 10B:
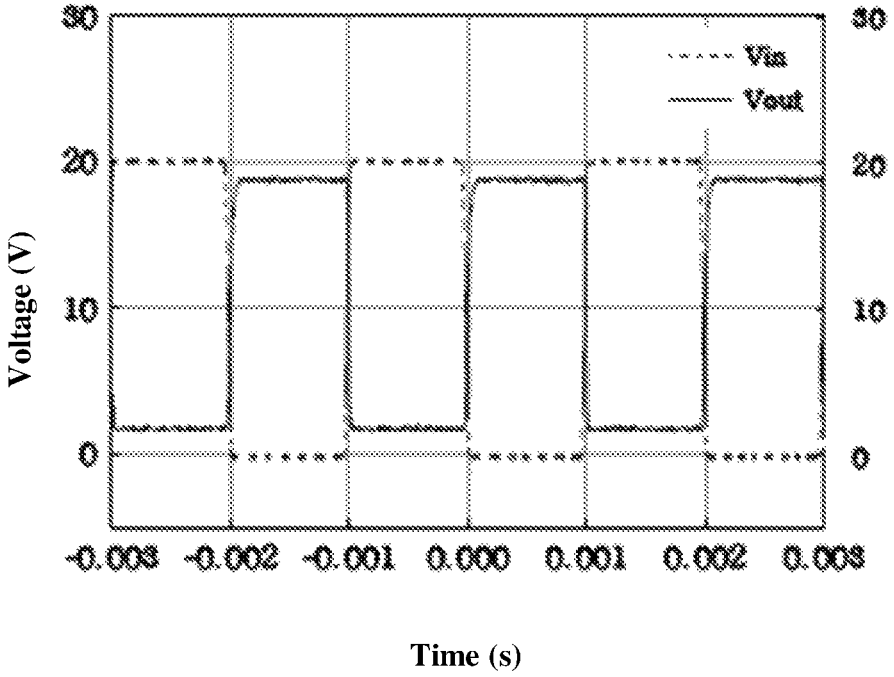

Specific reference can be made to FIGS. 9(*a*)-10(*b*). FIG. 9(*a*) and FIG. 9(*b*) are schematic diagrams of the component structure of an inverter according to the first embodiment of the present disclosure. FIG. 10(*a*) and FIG. 10(*b*) are schematic diagrams of the component structure of an inverter according to the second embodiment of the present disclosure.

FIG. 9(*a*) corresponds to the structure of the inverter in the first embodiment of the present disclosure, and FIG. 10(*a*) corresponds to the structure of the inverter in the second embodiment of the present disclosure. As can be seen from the waveform diagrams of FIG. 9(*b*) and FIG. 10(*b*), the second embodiment can further increase the voltage of the gate electrode of the second transistor M18, thereby compensating for the output attenuation and achieving a better isolation effect of the control circuit.

However, it should be noted by those skilled in the art that the structure of the inverter of the present disclosure is not limited to the above structure, but any other suitable inverter can be adopted depending on the actual application.

Figure 11:
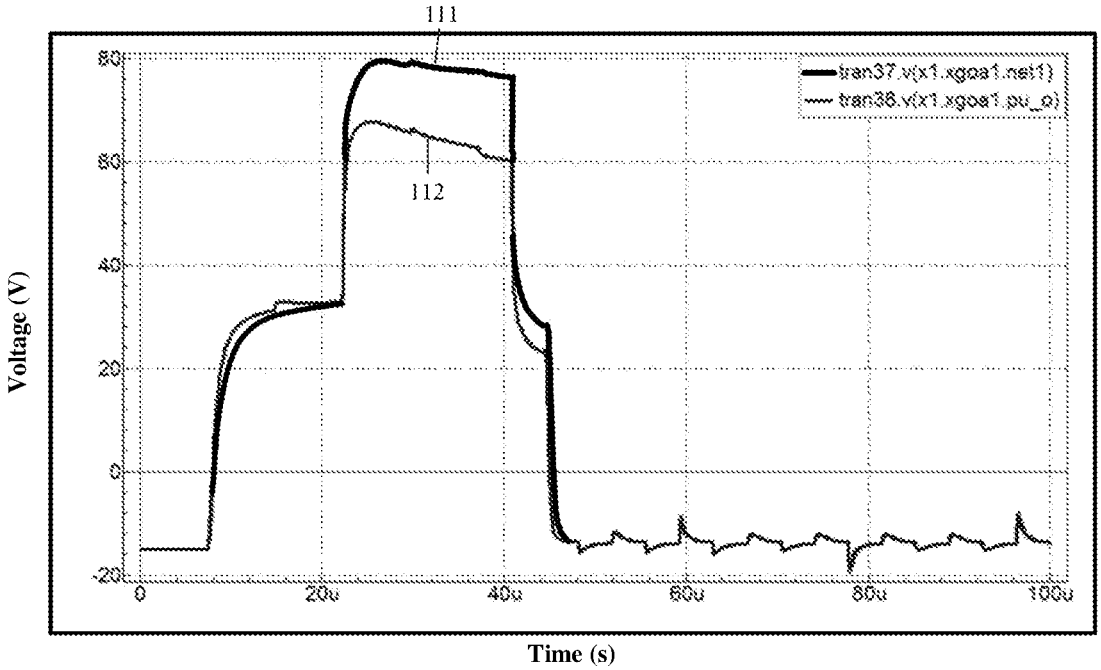
FIG. 11 is a comparison diagram of the voltage waveform of the pull-up node known to the inventors and the voltage waveform of the pull-up node according to an embodiment of the present disclosure.

FIG. 11 is a comparison diagram of the voltage waveform of the pull-up node known to the inventors and the voltage waveform of the pull-up node according to an embodiment of the present disclosure. The waveform of the black bold line 111 represents the voltage of the new pull-up node PU2 of the present disclosure, and the waveform of the black thin line 112 represents the voltages of the pull-up node PU known to the inventors.

According to FIG. 11, it can be seen that the black bold line 111 is significantly higher than the black thin line 112, that is, the voltage of the new pull-up node PU2 increases significantly. In addition, a slope of the black bold line 111 is significantly smaller than a slope of the black thin line 112, which shows that the leakage current of the PU maintaining phase is reduced.

By inserting the control circuit, the transistors, coupled to the clock signal, in the GOA circuit is isolated from other voltage-dividing transistors to enhance the clock coupling effect, and there is obtained the effect that the voltage of the pull-up node is increased and the leakage current is reduced. This results in the significant increase of the voltage of the gate control terminals of the transistors M3 and M11 in the output circuit, thereby reducing the turning-on time of the transistors M3 and M11 and further enhancing the driving capability of the transistors M3 and M11.

Figure 12:
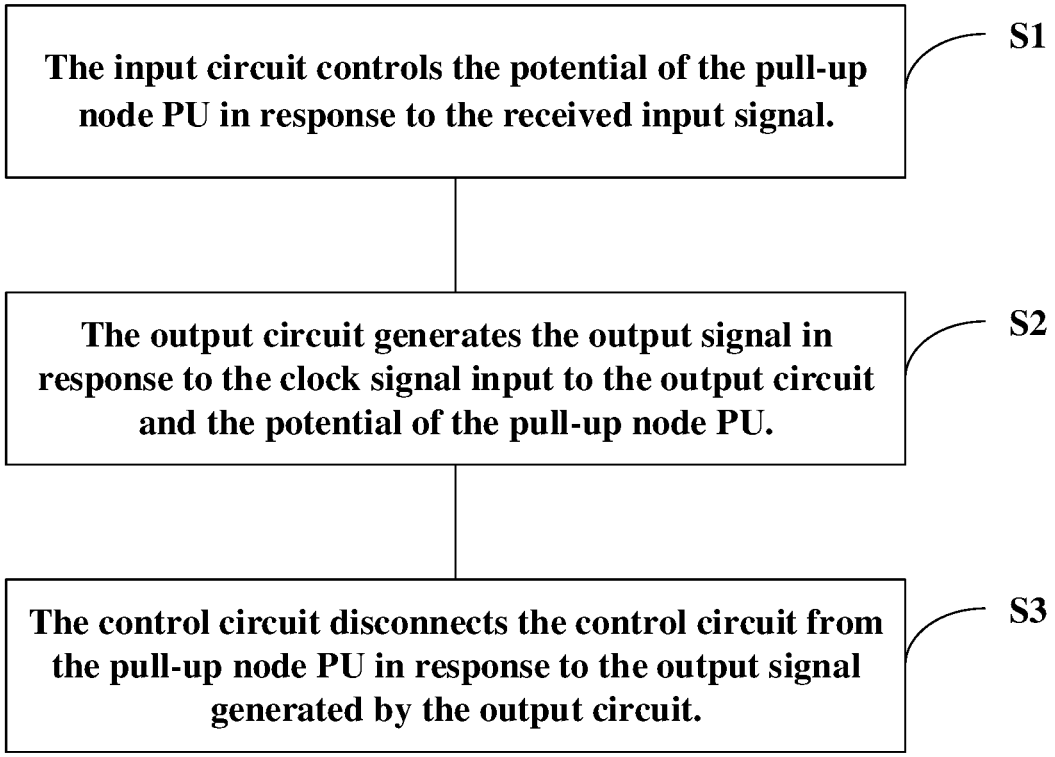
FIG. 12 is a flow chart of an operating method for a GOA unit according to an embodiment of the present disclosure.

FIG. 12 is a flow chart of a driving method for a GOA unit according to an embodiment of the present disclosure.

As shown in FIG. 12, the method can mainly include the following steps:

Step S1: The input circuit controls the potential of the pull-up node PU in response to the received input signal. That is, the input circuit receives a high-level voltage signal output by the preceding stage GOA unit as the input signal and turns on the transistor M1 in response to the high-level voltage signal, so as to control the potential of the pull-up node PU to change to a high level.

Step S2: The output circuit generates the output signal in response to the clock signal input to the output circuit and the potential of the pull-up node PU. That is, because the output transistors M3 and M11 are turned on when the clock signal CLK of the output circuit 50 jumps from a low level to a high level, the high-level signal of the clock signal CLK is transmitted to the gate electrode of M3 and the gate electrode of M11. The source electrode of M11, i.e., the output terminal Outc, outputs a high-level signal Outc, and the source electrode of M3, i.e., the output terminal Gout, outputs a high-level signal Gout.

Step S3: The control circuit disconnects the control circuit from the pull-up node PU in response to the output signal generated by the output circuit, that is, disconnects the control circuit from the input circuit, the reset circuit and the pull-down circuit. When the output signal is at a high level, the control circuit turns off the first transistor M16 through the action of the inverter, so as to disconnect the control circuit from the input circuit, the reset circuit and the pull-down circuit, so as to increase the voltage of the new pull-up node PU2.

Specifically, the high-level signal Outc output from the source electrode of M11, i.e., the output terminal Outc, turns on the third transistor M17. Because the resistance of the third transistor M17 is less than the resistance of the second transistor M18, the drain electrode of M17, the source electrode of M18, and the gate electrode of M16 all decrease in level, which causes the first transistor M16 to turn off. This corresponds to removing of loads of the transistors M1, M2, M6A, M6B, M8A, M8B, M10A and M10B, thereby enhancing the clock coupling effect and further increasing the output voltage of the drain electrode of the first transistor M16.

After step S3, when the falling edge of the clock signal of the output circuit arrives, the output transistors M3 and M11 are turned off and the levels of the output terminals Outc and Gout are pulled down rapidly. At this time, the transistor M17 is turned off, the levels of the drain electrode of M17, the source electrode of M18 and the gate electrode of M16 are raised. The level of the gate electrode of the first transistor M16 is raised so that the first transistor M16 is turned on. The turning-on state of the first transistor M16 causes the connection of the control circuit 60 with the pull-up node PU to resume, thereby turning on the connection of the source electrode of the first transistor M16 and the pull-up node PU.

The components included in the embodiments of the disclosure are not limited to software or hardware and can be configured to be stored in an addressable storage medium and run on one or more processors.

Thus, these components can include, by way of example, components such as software component, object-oriented component, class component and task component, process, function, property, procedure, subroutine, sections of program code, driver, firmware, microcode, circuit, data, databases, data structure, table, array and variable. The functionality provided in the components and the corresponding components can be combined in fewer components or can be further separated into additional components. For example, each component described as a single component can be distributed and practiced and, similarly, components described as distributed can also be practiced in integrated form.

Of course, those skilled in the art can recognize that some steps of the above-described processes can be omitted, concurrently or sequentially performed, or performed in a different order, unless the sequence of operations is specifically indicated or required. Furthermore, no components, elements or processes are to be considered essential to any particular claimed embodiment and each of these components, elements, or processes can be combined in other embodiments.

Although the methods and systems of the present disclosure have been described in connection with particular embodiments, some or all of the components or their operations can be implemented by a computer system having a general purpose hardware architecture.

The description of the present disclosure is intended to be illustrative, and it will be understood by those skilled in the art that the present disclosure can be readily modified in other detailed forms without changing the technical spirit or necessary characteristics of the present disclosure. Therefore, the above embodiments are to be considered as illustrative and not restrictive. Therefore, the spirit of the present disclosure is not limited to the presented embodiments, and other embodiments can be easily designed through the addition, modification, deletion or insertion of components within the same spirit as the present disclosure, but it will be understood that these other embodiments can also be included within the scope of the present disclosure.

The present application claims the priority of a Chinese patent application No. 201710001592.2 filed on Jan. 3, 2017, and the entire content disclosed by the Chinese patent application is incorporated herein by reference as part of the present application.

What is claimed is:

1. A gate driver on array (GOA) unit, comprising:

an input circuit, connected with an input signal terminal and a pull-up node PU;

a pull-down circuit, connected with a first voltage signal terminal and the pull-up node PU;

a pull-down control circuit, connected with the pull-down circuit via a pull-down node PD;

an output circuit, connected with a clock signal terminal, a second voltage signal terminal and a control circuit;

a reset circuit, connected with a reset signal terminal, the first voltage signal terminal and the pull-up node PU; and the control circuit, connected with the pull-up node PU and the output circuit, wherein the input circuit controls a potential of the pull-up node PU in response to a received input signal;

the output circuit generates an output signal in response to a clock signal input to the output circuit and the potential of the pull-up node PU;

the control circuit disconnects the control circuit from the pull-up node PU in response to the output signal generated by the output circuit;

the output circuit comprises a first output transistor and a second output transistor, drain electrodes of the first output transistor and the second output transistor are connected with the clock signal terminal, a source electrode of the first output transistor is connected with an output terminal of the output circuit;

the control circuit comprises an inverter and a control switching element;

the control switching element comprises a first transistor, a drain electrode of the first transistor is connected with gate electrodes of the first output transistor and the second output transistor, and a source electrode of the first transistor is connected with the input circuit, the reset circuit and the pull-down circuit via the pull-up node PU;

the inverter comprises a second transistor and a third transistor, a gate electrode and a drain electrode of the second transistor are connected with a third voltage signal terminal, and a source electrode of the second transistor is connected with the gate electrode of the first transistor and a drain electrode of the third transistor; and a source electrode of the second output transistor is connected with the gate electrode of the third transistor.

2. The GOA unit according to claim 1, wherein:

the inverter further comprises a fourth transistor, the drain electrode of the second transistor and a gate electrode and a drain electrode of the fourth transistor are connected with the third voltage signal terminal, and a gate electrode of the second transistor is connected with a source electrode of the fourth transistor.

3. The GOA unit according to claim 1, wherein a source electrode of the third transistor is connected with the first voltage signal terminal.

4. The GOA unit according to claim 1, wherein resistance of the second transistor is greater than resistance of the third transistor.

5. The GOA unit according to claim 1, wherein the clock signal, a first voltage signal, a second voltage signal and a third voltage signal are input to the GOA unit.

6. A driving method for a gate driver on array (GOA) unit, the GOA unit comprising:

an input circuit, connected with an input signal terminal and a pull-up node PU;

a pull-down circuit, connected with a first voltage signal terminal and the pull-up node PU;

a pull-down control circuit, connected with the pull-down circuit via a pull-down node PD;

an output circuit, connected with a clock signal terminal, a second voltage signal terminal and a control circuit;

a reset circuit, connected with a reset signal terminal, the first voltage signal terminal and the pull-up node PU; and the control circuit, connected with the pull-up node PU and the output circuit, wherein the input circuit controls a potential of the pull-up node PU in response to a received input signal;

the output circuit generates an output signal in response to a clock signal input to the output circuit and the potential of the pull-up node PU;

the control circuit disconnects the control circuit from the pull-up node PU in response to the output signal generated by the output circuit;

the output circuit comprises a first output transistor and a second output transistor, drain electrodes of the first output transistor and the second output transistor are connected with the clock signal terminal, a source electrode of the first output transistor is connected with an output terminal of the output circuit;

the control circuit comprises an inverter and a control switching element;

the control switching element comprises a first transistor, a drain electrode of the first transistor is connected with gate electrodes of the first output transistor and the second output transistor, and a source electrode of the first transistor is connected with the input circuit, the reset circuit and the pull-down circuit via the pull-up node PU;

the inverter comprises a second transistor and a third transistor, a gate electrode and a drain electrode of the second transistor are connected with a third voltage signal terminal, and a source electrode of the second transistor is connected with the gate electrode of the first transistor and a drain electrode of the third transistor; and a source electrode of the second output transistor is connected with the gate electrode of the third transistor, the driving method comprises:

controlling the potential of the pull-up node PU by the input circuit in response to the received input signal;

generating the output signal by the output circuit in response to the clock signal input to the output circuit and the potential of the pull-up node PU; and disconnecting the control circuit from the pull-up node PU by the control circuit in response to the output signal generated by the output circuit.

7. The driving method for the GOA unit according to claim 6, wherein:

the control circuit disconnects a source electrode of a first transistor included in the control circuit from the pull-up node PU in response to the output signal generated by the output circuit.

8. The driving method for the GOA unit according to claim 7, further comprising:

the control circuit switches on the connection of the source electrode of the first transistor to the pull-up node PU in response to the clock signal input to the output circuit, after disconnecting the source electrode of the first transistor from the pull-up node PU.

9. A GOA apparatus, comprising a plurality of cascaded GOA units according to claim 1.

10. The GOA apparatus according to claim 9, wherein in the cascaded GOA units, a signal input terminal of each GOA unit except for a first GOA unit and a last GOA unit is connected with an output terminal of a preceding GOA unit that is adjacent to the each GOA, and a reset signal terminal of each GOA unit except for the first GOA unit and the last GOA unit is connected with an output terminal of a following GOA unit that is adjacent to the each GOA.

11. A display apparatus, comprising the GOA apparatus according to claim 9.

* * * * *